US006622900B1

(12) United States Patent
Barnett

(10) Patent No.: US 6,622,900 B1
(45) Date of Patent: Sep. 23, 2003

(54) FOIL DISPENSING DEVICE

(76) Inventor: Olga E. Barnett, 3766 Rosemar Ave., San Jose, CA (US) 95127

( * ) Notice: Subject to any disclaimer, the term of this patent is extended or adjusted under 35 U.S.C. 154(b) by 244 days.

(21) Appl. No.: 09/849,713

(22) Filed: May 4, 2001

(51) Int. Cl.[7] ..... B26F 3/02
(52) U.S. Cl. ..... 225/46; 225/56; 225/77
(58) Field of Search ..... 225/43, 44, 46, 225/56, 77

(56) References Cited

U.S. PATENT DOCUMENTS

| | | | | | |
|---|---|---|---|---|---|
| 1,357,070 | A | | 10/1920 | Matthews | |
| 3,094,323 | A | | 6/1963 | Catania | |
| 3,142,217 | A | | 7/1964 | Busse | |
| 3,698,548 | A | | 10/1972 | Stenzel et al. | |
| 3,768,713 | A | * | 10/1973 | Lash | 225/34 |
| 3,989,175 | A | * | 11/1976 | Cherrin | 225/76 |
| D272,021 | S | | 1/1984 | Ruff | |
| 4,875,609 | A | * | 10/1989 | Elder et al. | 225/13 |
| 4,951,858 | A | * | 8/1990 | Krall | 225/19 |
| 4,991,738 | A | | 2/1991 | Peterson | |
| 5,104,000 | A | | 4/1992 | Goff | |
| 5,193,726 | A | * | 3/1993 | Humphrey | 225/4 |
| 5,322,190 | A | | 6/1994 | Bartley | |
| 5,350,099 | A | * | 9/1994 | Kienzle | 225/34 |
| 6,250,530 | B1 | * | 6/2001 | LaCount et al. | 225/10 |

* cited by examiner

*Primary Examiner*—Kenneth E. Peterson
*Assistant Examiner*—Omar Flores Sánchez

(57) ABSTRACT

A foil dispensing device for cutting foil in selected lengths for using the foil for hair highlighting purposes. The foil dispensing device includes a housing having a bottom wall, a back wall, a front wall, and a pair of side walls. The foil is positioned in an interior of the housing and accessed through an open top side of the housing. A cutting device comprises a substantially rigid panel having a size. The panel has a front surface, a top edge and a pair of side edges. Each of a pair of legs is attached to one of the side edges and is adjacent to a bottom edge of the panel. Each of the legs extends outwardly away from the back surface in a generally parallel direction with relation to each other such that each may be abutted against one of the side walls. The foil is cut on teeth.

5 Claims, 3 Drawing Sheets

FOIL DISPENSING DEVICE

BACKGROUND OF THE INVENTION

1. Field of the Invention

The present invention relates to foil dispensing devices and more particularly pertains to a new foil dispensing device for cutting foil in selected lengths for using the foil for hair highlighting purposes.

2. Description of the Prior Art

The use of foil dispensing devices is known in the prior art. More specifically, foil dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,991,738; U.S. Pat. No. 3,094,323; U.S. Pat. No. 1,357,070, U.S. Pat. No. 3,142,217; U.S. Pat. No. 5,322,190; U.S. Pat. No. 5,104,000; U.S. Des. Pat. No. 272,021; and U.S. Pat. No. 3,698,548.

While these devices fulfill their respective, particular objectives and requirements, the aforementioned patents do not disclose a new foil dispensing device. The inventive device includes a housing having a bottom wall, a back wall, a front wall, and a pair of sidewalls. The foil is positioned in an interior of the housing and accessed through an open top side of the housing. A cutting device comprises a substantially rigid panel having a size and shape substantially equal to a size and shape of the front wall. The panel has a front surface, a top edge and a pair of side edges. Each of a pair of legs is attached to one of the side edges and is adjacent to a bottom edge of the panel. Each of the legs extends outwardly away from the back surface in a generally parallel direction with relation to each other such that each may be abutted against one of the side walls. The foil is cut on teeth coupled to the panel and extending upwardly from the top edge of the panel.

In these respects, the foil dispensing device according to the present invention substantially departs from the conventional concepts and designs of the prior art, and in so doing provides an apparatus primarily developed for the purpose of cutting foil in selected lengths for using the foil for hair highlighting purposes.

SUMMARY OF THE INVENTION

In view of the foregoing disadvantages inherent in the known types of foil dispensing devices now present in the prior art, the present invention provides a new foil dispensing device construction wherein the same can be utilized for cutting foil in selected lengths for using the foil for hair highlighting purposes.

The general purpose of the present invention, which will be described subsequently in greater detail, is to provide a new foil dispensing device apparatus and method which has many of the advantages of the foil dispensing devices mentioned heretofore and many novel features that result in a new foil dispensing device which is not anticipated, rendered obvious, suggested, or even implied by any of the prior art foil dispensing devices, either alone or in any combination thereof.

To attain this, the present invention generally comprises a housing having a bottom wall, a back wall, a front wall, and a pair of side walls. The foil is positioned in an interior of the housing and accessed through an open top side of the housing. A cutting device comprises a substantially rigid panel having a size and shape substantially equal to a size and shape of the front wall. The panel has a front surface, a top edge and a pair of side edges. Each of a pair of legs is attached to one of the side edges and is adjacent to a bottom edge of the panel. Each of the legs extends outwardly away from the back surface in a generally parallel direction with relation to each other such that each may be abutted against one of the side walls. The foil is cut on teeth coupled to the panel and extending upwardly from the top edge of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foil dispensing device apparatus and method which has many of the advantages of the foil dispensing devices mentioned heretofore and many novel features that result in a new foil dispensing device which is not anticipated, rendered obvious, suggested, or even implied by any of the prior art foil dispensing devices, either alone or in any combination thereof.

It is another object of the present invention to provide a new foil dispensing device which may be easily and efficiently manufactured and marketed.

It is a further object of the present invention to provide a new foil dispensing device which is of a durable and reliable construction.

An even further object of the present invention is to provide a new foil dispensing device which is susceptible of a low cost of manufacture with regard to both materials and labor, and which accordingly is then susceptible of low prices of sale to the consuming public, thereby making such foil dispensing device economically available to the buying public.

Still yet another object of the present invention is to provide a new foil dispensing device which provides in the apparatuses and methods of the prior art some of the advantages thereof, while simultaneously overcoming some of the disadvantages normally associated therewith.

Still another object of the present invention is to provide a new foil dispensing device for cutting foil in selected lengths for using the foil for hair highlighting purposes.

Yet another object of the present invention is to provide a new foil dispensing device which includes a housing having a bottom wall, a back wall, a front wall, and a pair of side walls. The foil is positioned in an interior of the housing and accessed through an open top side of the housing. A cutting device comprises a substantially rigid panel having a size and shape substantially equal to a size and shape of the front wall. The panel has a front surface, a top edge and a pair of side edges. Each of a pair of legs is attached to one of the side edges and is adjacent to a bottom edge of the panel. Each of the legs extends outwardly away from the back surface in a generally parallel direction with relation to each other such that each may be abutted against one of the side walls. The foil is cut on teeth coupled to the panel and extending upwardly from the top edge of the panel.

Still yet another object of the present invention is to provide a new foil dispensing device that includes a lever for placing pressure on the foil against the cutting device for easy cutting of the foil.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
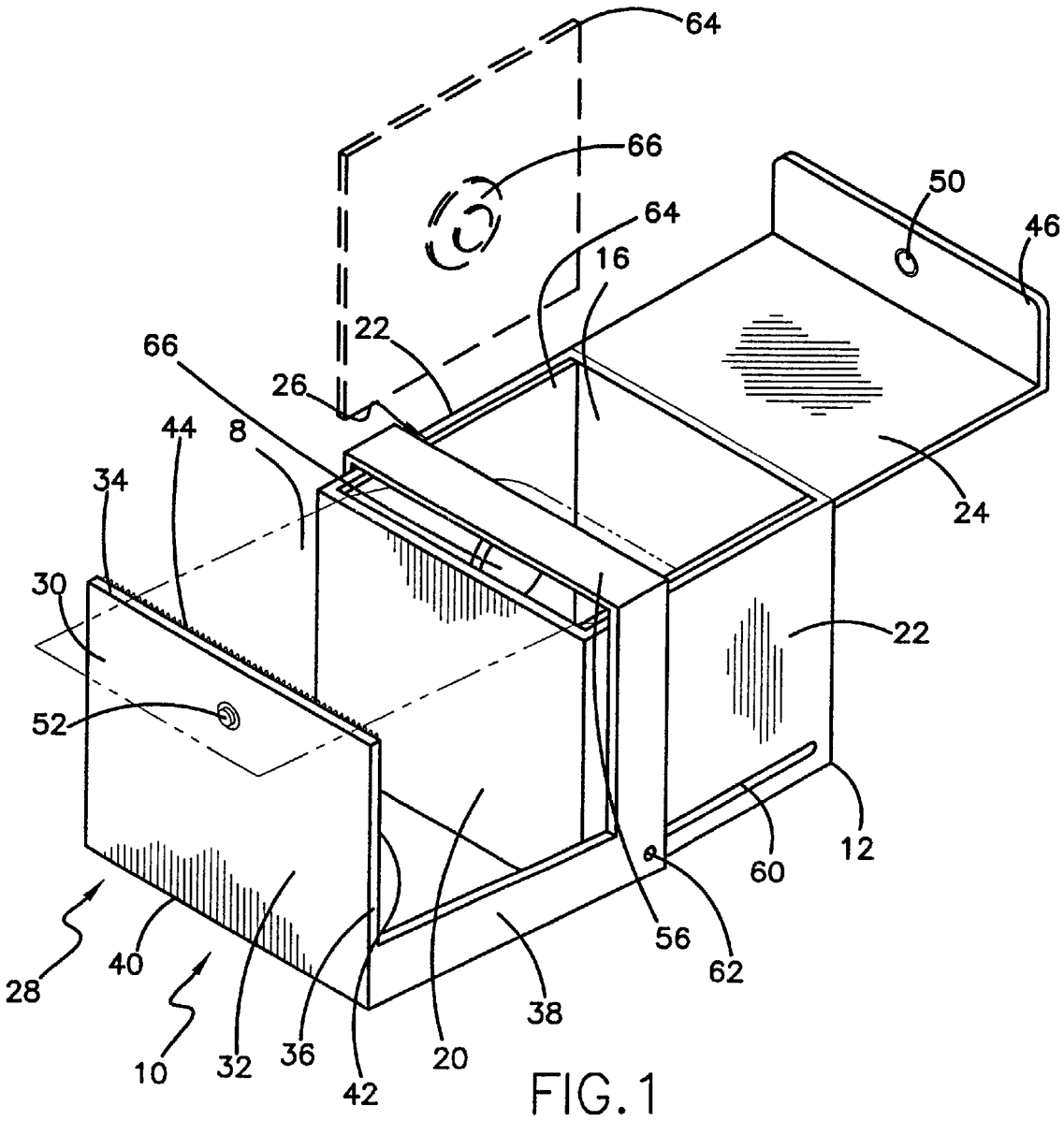
FIG. 1 is a schematic perspective view of a new foil dispensing device according to the present invention.
Figure 2:
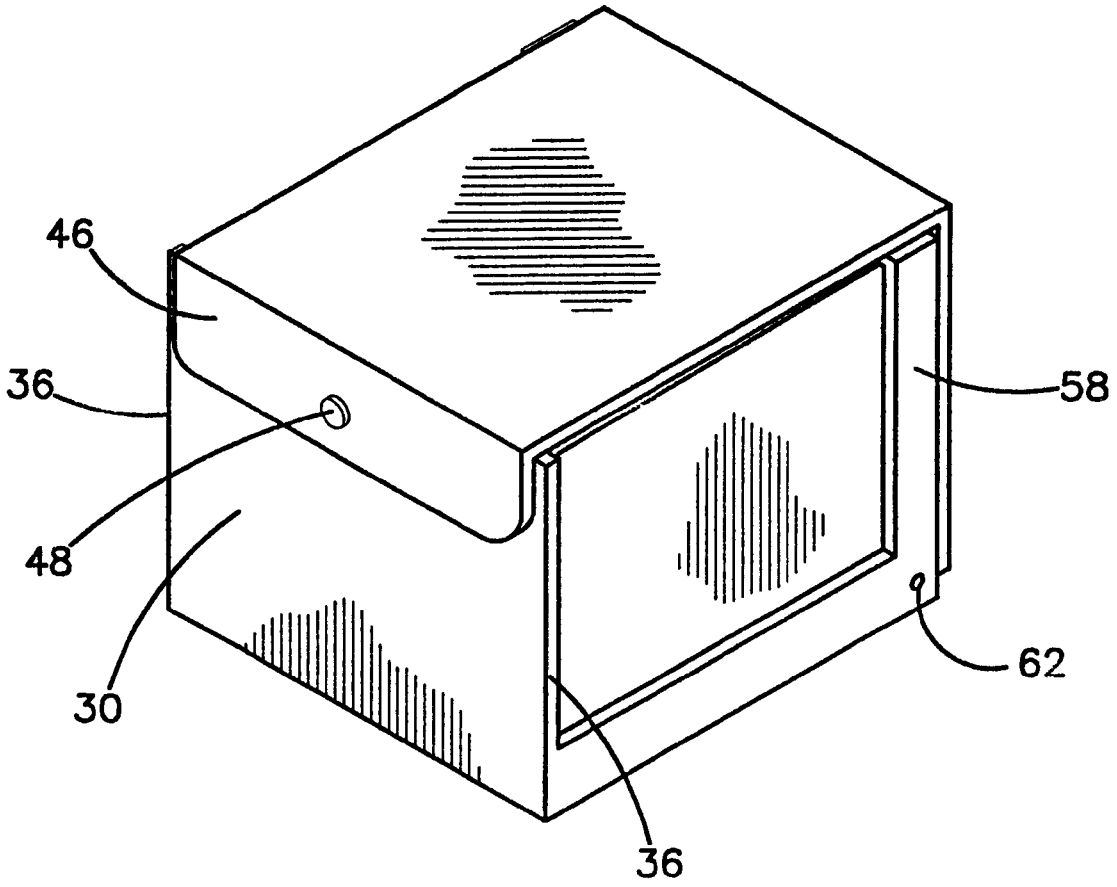
FIG. 2 is a schematic perspective view of the present invention.
Figure 3:
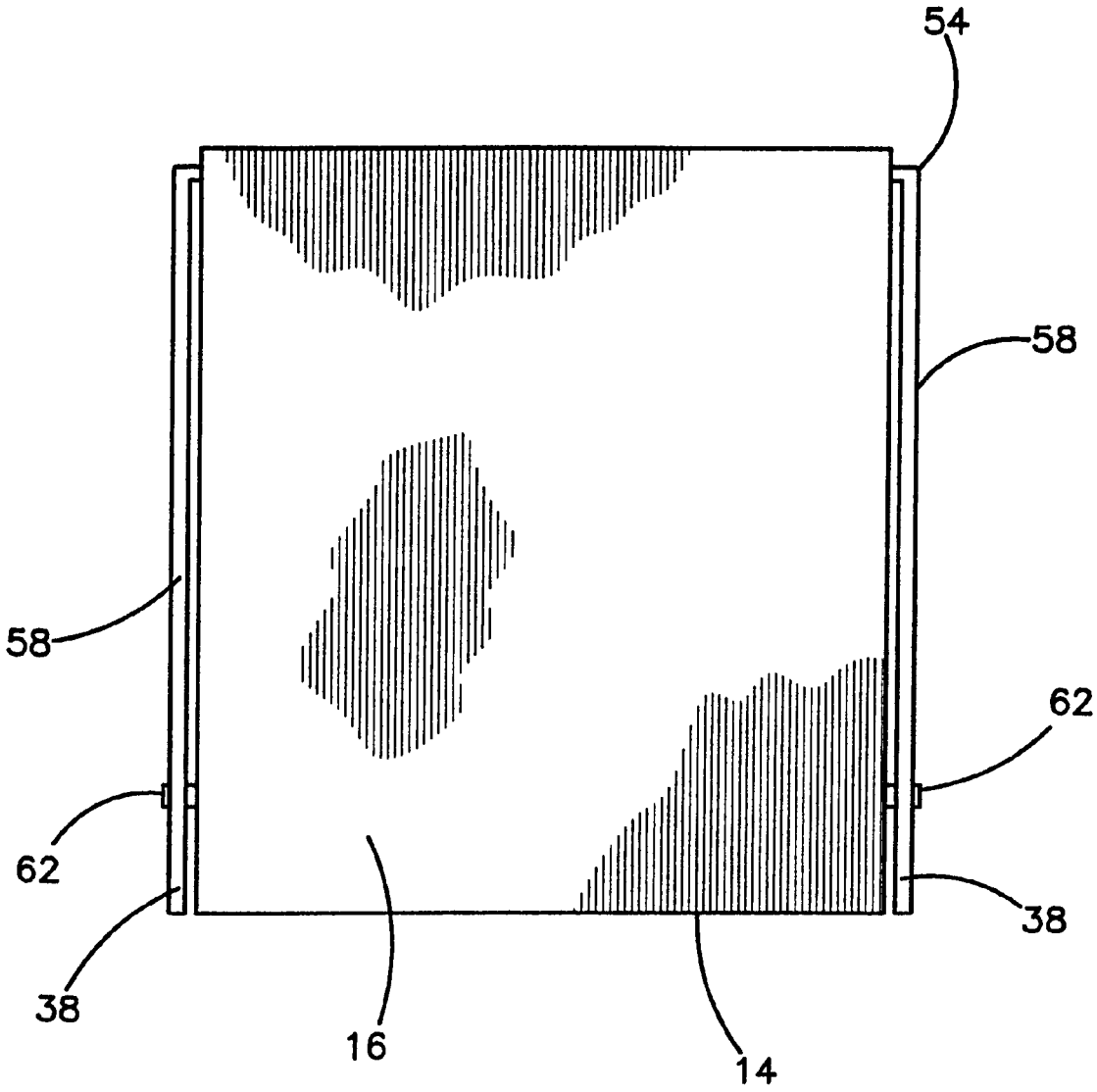
FIG. 3 is a schematic back view of the present invention.

With reference now to the drawings, and in particular to FIGS. 1 through 3 thereof, a new foil dispensing device embodying the principles and concepts of the present invention and generally designated by the reference numeral 10 will be described.

As best illustrated in FIGS. 1 through 3, the foil dispensing device 10 generally comprises a housing 12 having a bottom wall 14, a back wall 16, a front wall 20, and a pair of side walls 22. A top wall 24 is pivotally coupled to a top edge of the back wall 16 for selectively covering an open top side 26 of the housing 12. Foil 8 is positioned in an interior of the housing and accessed through the open top side. Each of the side walls has an elongated slot 60 therein extending between the front 20 and back 16 walls and being located generally adjacent to the bottom wall 14. Each of the side walls has a length preferably between 5 inches and 6 inches and height preferably between 4 inches and 6 inches. The front and back walls has a length preferably between 5 inches and 7 inches.

A cutting device 28 comprises a substantially rigid panel 30 having a size and shape substantially equal to a size and shape of the front wall 20. The panel 30 has a front surface 32, a top edge 34 and a pair of side edges 36. Each of a pair of legs 38 is attached to one of the side edges 36 and is adjacent to a bottom edge 40 of the panel 30. Each of the legs 38 extends outwardly away from the a back surface 42 in a generally parallel direction with relation to each other such that each may be abutted against one of the side walls 22. Each of a pair of pins 62 extends through one of the legs and is positioned distal to the panel. Each of said pins extends into and is movable along one of said slots 60. A serrated edge 44 with a plurality of teeth is attached to the back surface 42 of the panel 30 such that the teeth extend upwardly from the top edge 34 of the panel 30.

A flap 46 is coupled to an edge of the top wall 24 and is positioned for selectively abutting the front surface 32 of the panel 30 when the panel 30 is abutting the housing 12.

A securing means 48 removably secures the flap 46 to the panel 30. The securing means includes a female snap portion 50 attached to an inner surface of the flap 46 and a male snap portion 52 attached to the front surface 32 of the panel 30 and positioned to releasably engage the female snap portion 50.

A lever 54 has a middle portion 56 and each of a pair of arms 58 is attached to one of a pair of ends of the middle portion 56. Each of the arms 58 has a free end attached to one of the legs 38 such that said middle portion traverses the open top side of the housing 12. An angle between each of the arms 58 and an associated one of the legs 38 is preferably equal to 75 degrees.

A pair of guide members 64 are positionable in the housing and each comprises a plate having a front side and a back side. Each of the guide members 64 is abuttable and generally covers one of the side walls 22. Each of the front sides has a disc 66 centrally attached thereto. Each of the discs is removably extended into one of a pair of ends of a roll of foil 8.

In use, the foil 8 is positioned in the housing 12 and extended outwardly of the housing 12 below the middle portion 56 such that the foil 8 may be cut with the teeth 44. The middle portion 56 may be pressed down on the foil 8 to hold it place for easier cutting. A hair dresser may then remove strips of foil in a selected length for use on the hair of person.

As to a further discussion of the manner of usage and operation of the present invention, the same should be apparent from the above description. Accordingly, no further discussion relating to the manner of usage and operation will be provided.

With respect to the.above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foil dispensing and cutting device for cutting portions of a roll of foil, said device comprising:

a housing having a bottom wall, a back wall, a front wall, and a pair of side walls, wherein said foil is positioned in an interior of said housing and accessed through an open top side of said housing, each of said side walls having an elongated slot therein extending between said front and back walls and being located generally adjacent to said bottom wall;

a cutting device comprising a substantially rigid panel having a size and shape substantially equal to a size and shape of said front wall, said panel having a front surface, a top edge and a pair of side edges, each of a pair of legs being attached to one of said side edges and being adjacent to a bottom edge of said panel, each of said legs extending outwardly away from said back surface in a generally parallel direction with relation to each other such that each may be abutted against one of said side walls, a plurality of teeth being attached to said back surface of said panel and extending upwardly from said top edge of said panel, each of a pair of pins extending through one of said legs and being positioned distal to said panel, each of said pins extending into and being movable along one of said slots;

a lever having a middle portion and a pair of arms each being attached to one of a pair of ends of said middle portion, each of said arms having a free end attached to one of said legs such that said middle portion traverses said open ton side of said housing, an angle between each of said arms and an associated legs being generally equal to 75 degrees; and wherein said foil is positioned in said housing extended outwardly of said housing below said middle portion such that said foil may be cut with said teeth.

2. The foil dispensing and cutting device as in claim 1, wherein said housing includes a top wall being pivotally coupled to a top edge of said back wall for selectively covering said open top side of said housing.

3. The foil dispensing and cutting device as in claim 2, further including:

a flap being coupled to an edge of said top wall and being positioned for selectively abutting said front surface of said panel when said panel is abutting said housing; and a securing means removably secures said flap to said panel.

4. The foil dispensing and cutting device as in claim 3, wherein said securing means includes a female snap portion attached to an inner surface of said flap and a male snap portion attached to said front surface of said panel and positioned to releasably engage said female snap portion.

5. A foil dispensing and cutting device for dispensing and cutting portions of a roll of foil, said device comprising:

a housing having a bottom wall, a back wall, a front wall, and a pair of side walls, a top wall being pivotally coupled to a top edge of said back wall for selectively covering an open top side of said housing, wherein said foil is positioned in an interior of said housing and accessed through said open top side, each of said side walls having a length generally between 5 inches and 6 inches and height generally between 4 inches and 6 inches, said front and back walls having a length generally between 5 inches and 7 inches, each of said side walls having an elongated slot therein extending between said front and back walls and being located generally adjacent to said bottom wall;

a pair of guide members being positionable in said housing and each comprising a plate having a front side and a back side, each of said guide members being abuttable and generally covering one of said side walls, each of said front sides having a disc centrally attached thereto, wherein each of said discs is removably extended into one of a pair of ends of said roll of foil;

a cutting device comprising a substantially rigid panel having a size and shape substantially equal to a size and shape of said front wall, said panel having a front surface, a top edge and a pair of side edges, each of a pair of legs being attached to one of said side edges and being adjacent to a bottom edge of said panel, each of said legs extending outwardly away from said back surface in a generally parallel direction with relation to each other such that each may be abutted against one of said side walls, a plurality of teeth being attached to said back surface of said panel and extending upwardly from said top edge of said panel, each of a pair of pins extending through one of said legs and being positioned distal to said panel, each of said pins extending into and being movable along one of said slots;

a lever having a middle portion and a pair of arms each being attached to one of a pair of ends of said middle portion, each of said arms having a free end attached to one of said legs such that said middle portion traverses said open top side of said housing, an angle between each of said arms and an associated legs being generally equal to 75 degrees;

a flap being coupled to an edge of said top wall and being positioned for selectively abutting said front surface of said panel when said panel is abutting said housing;

a securing means removably secures said flap to said panel, said securing means including a female snap portion attached to an inner surface of said flap and a male snap portion attached to said front surface of said panel and positioned to releasably engage said female snap portion;

wherein said foil is extended outwardly of said housing below said middle portion such that said foil may be cut with said teeth.

* * * * *